US009997312B2

(12) United States Patent
Ozil et al.

(10) Patent No.: US 9,997,312 B2
(45) Date of Patent: Jun. 12, 2018

(54) CIRCUIT BREAKER COMPRISING AN INSULATING HOLLOW TUBE

(71) Applicant: Alstom Technology Ltd., Baden (CH)

(72) Inventors: Joël Ozil, Saint Andre de Corcy (FR); René Rosset, Villette d'Anthon (FR); Matthieu Barre, Saint Andeol le Chateau (FR); Victor Hermosillo, Bethel Park, PA (US)

(73) Assignee: ALSTOM TECHNOLOGY LTD., Baden (CH)

( * ) Notice: Subject to any disclaimer, the term of this patent is extended or adjusted under 35 U.S.C. 154(b) by 0 days. days.

(21) Appl. No.: 15/326,917

(22) PCT Filed: Jul. 17, 2015

(86) PCT No.: PCT/EP2015/066479

§ 371 (c)(1),
(2) Date: Jan. 17, 2017

(87) PCT Pub. No.: WO2016/009071

PCT Pub. Date: Jan. 21, 2016

(65) Prior Publication Data

US 2017/0213674 A1 Jul. 27, 2017

(30) Foreign Application Priority Data

Jul. 18, 2014 (EP) ..... 14177671

(51) Int. Cl.
*H01H 33/662* (2006.01)
*H01H 33/56* (2006.01)
*H01H 33/666* (2006.01)

(52) U.S. Cl.
CPC ..... *H01H 33/662* (2013.01); *H01H 33/565* (2013.01); *H01H 33/666* (2013.01)

(58) Field of Classification Search
CPC ..... H01H 33/666; H01H 2033/6623; H01H 33/6606; H01H 2033/6667;
(Continued)

(56) References Cited

U.S. PATENT DOCUMENTS 3,792,213 A * 2/1974 Kane ..... H01H 33/666 218/4
8,723,070 B2 * 5/2014 Yoshida ..... H02B 13/0354 218/118
(Continued)

FOREIGN PATENT DOCUMENTS

JP 2013-055738 A 3/2013

OTHER PUBLICATIONS

Search Report issued in European Application No. 14 17 7671 dated Jan. 15, 2015.
(Continued)

*Primary Examiner* — Truc Nguyen
(74) *Attorney, Agent, or Firm* — Pearne & Gordon LLP

(57) ABSTRACT

The invention relates to a circuit breaker (10) for an electricity transport installation, the circuit breaker comprising a tank (12), a vacuum bottle (20) that has a stationary contact (24), a movable contact (26), and sealing means (40), a casing (30) that is arranged inside the tank (12), that electrically connects the movable contact (26) to an electrical conductor (18), and that co-operates with an outside wall of the vacuum bottle (20) to define a volume (42) that is taken to a pressure close to atmospheric pressure, and feeder means for feeding the inside volume (42) of the casing (30), which feeder means pass through the inside volume (14) of the tank (12), the circuit breaker being characterized in that the feeder means for feeding the inside volume (42) of the casing (30) consist in a tubular element (38, 54, 56) made of insulating material.

9 Claims, 2 Drawing Sheets

(58) Field of Classification Search
CPC ..... H01H 33/6661; H01H 33/027; H01H 1/5822; H01H 2033/566; H01H 2033/6665; H01H 33/022; H01H 33/66207; H01H 33/6662; H01H 33/662
See application file for complete search history.

(56) References Cited

U.S. PATENT DOCUMENTS

| | | | | |
|---|---|---|---|---|
| 9,082,572 | B2 * | 7/2015 | Yoshida | H01H 33/6606 |
| 9,136,674 | B2 * | 9/2015 | Ohtsuka | H02B 13/0354 |
| 9,214,306 | B2 * | 12/2015 | Yoshida | H01H 33/662 |
| 2010/0288733 | A1 * | 11/2010 | Ichikawa | H01H 33/666 218/134 |
| 2012/0061353 | A1 | 3/2012 | Hatanaka | |
| 2013/0126481 | A1 | 5/2013 | Ozil | |
| 2013/0155640 | A1 * | 6/2013 | Sano | H02B 13/0356 361/816 |
| 2013/0213937 | A1 | 8/2013 | Yoshida | |

OTHER PUBLICATIONS

International Preliminary Report on Patentability issued in Application No. PCT/EP2015/066479 dated Nov. 2, 2016.
International Search Report issued in Application No. PCT/EP2015/066479 dated Aug. 20, 2015.
Written Opinion issued in Application No. PCT/EP2015/066479 dated Aug. 20, 2015.
Utility U.S. Appl. No. 15/058,857,"Internal Tulip Sleeve of the Female Arcing Contact of a High Voltage Electric Circuit Breaker" filed Mar. 2, 2016.

* cited by examiner

CIRCUIT BREAKER COMPRISING AN INSULATING HOLLOW TUBE

TECHNICAL FIELD

The invention relates to a circuit breaker for a high voltage electricity transport line, which circuit breaker includes a vacuum bottle arranged in the pressurized inside volume of the tank of the circuit breaker.

The invention relates more particularly to a circuit breaker having an intermediate volume for the purpose of limiting the stresses that are generated by pressure differences on the sealing means of the vacuum bottle.

STATE OF THE PRIOR ART

A vacuum bottle for a high voltage electricity transport line mainly comprises a hermetically sealed enclosure having arranged therein a stationary contact and a movable contact.

The movable contact is suitable for moving inside the enclosure between a position in which it is in contact with the stationary contact, and a position at a distance from the stationary contact.

A vacuum is established inside the enclosure to prevent electric arcs forming while contact is being broken between the two electrical contacts.

The movable contact is moved by control means arranged outside the vacuum bottle. For this purpose, the movable contact has a rod that passes through a wall of the enclosure.

Finally, in order to conserve the vacuum, sealing means are arranged between the movable contact and the edge of the opening through which the movable contact rod passes.

The vacuum bottle is arranged inside a tank that is filled with dielectric gas under pressure. This pressure thus acts on one side of the sealing means, while a vacuum acts on the other side of the sealing means.

A large pressure difference acting on opposite sides of the sealing means puts a limit on the lifetime of the vacuum bottle, and as a result this makes it necessary to take action on the circuit breaker in order to replace a damaged vacuum bottle with a new vacuum bottle.

Document US-A-2010/0288733 describes a circuit breaker in which a contact carrier casing that connects the movable contact electrically to an electrical conductor of the circuit breaker forms a hollow volume that is isolated and in which there is a pressure that is close to atmospheric pressure.

Thus, the pressure difference at opposite ends of the sealing means is relatively small, thereby enabling the lifetime of the sealing means to be lengthened.

According to that document, the conductor connected to the movable contact is hollow, i.e. it consists in a tubular element, and it opens out into the hollow volume formed by the casing, in order to feed the hollow volume with gas at atmospheric pressure.

Such an embodiment is particularly complex to make, in particular at the connection between the hollow conductor and the casing. When it is passing electricity, the temperature of the conductor rises and the conductor therefore expands. This means that it is necessary to use complex sealing means between the conductor and the casing, and also at the connection between the conductor and the connector support means, which are mounted on the tank.

An object of the invention is to propose a circuit breaker including simplified means for connecting with the hollow volume formed by the casing.

SUMMARY OF THE INVENTION

The invention provides a circuit breaker for an electricity transport installation, the circuit breaker comprising:

- a tank filled with a dielectric gas under pressure;
- a vacuum bottle arranged in the tank, the vacuum bottle comprising an enclosure in which a vacuum is made, a stationary contact and a movable contact arranged in the enclosure of the vacuum bottle, in which the movable contact includes a drive rod that passes through an opening formed in an end wall of the enclosure and that is connected to drive means for driving the movable contact, and sealing means between the edge of the opening in said end wall of the enclosure and the movable contact;
- a casing arranged in the tank and electrically connecting the movable contact to an electrical conductor, which casing co-operates with said end wall of the enclosure of the vacuum bottle to define a volume that is isolated from the inside volumes of the tank and of the enclosure of the vacuum bottle, which isolated volume is taken to a pressure close to atmospheric pressure; and
- feeder means for feeding the inside volume of the casing, which feeder means pass through the inside volume of the tank;
  - the circuit breaker being characterized in that the feeder means for feeding the inside volume of the casing comprise a tubular element made of insulating material.

The use of an insulating tube makes it possible to connect the inside volume of the casing to a source of gas without any risk of harming the electrical insulation provided by the dielectric gas contained in the circuit breaker tank.

Preferably, said tubular element consists in a motion transmission bar that extends from the drive means to the rod of the movable contact, having one end connected to the rod of the movable contact and opening out inside the inside volume of the casing.

Preferably, the motion transmission bar passes through a wall of the tank in sealed manner and includes another end that is situated outside the tank.

Preferably, the circuit breaker includes a housing adjacent to the tank, which housing defines a closed volume in which at least a portion of the drive means and the second end of the transmission bar are situated.

Preferably, the volume defined by the housing is isolated from ambient air and from the inside volume of the tank and is connected to the inside volume of the casing via the transmission bar.

Preferably, the volume defined by the housing is isolated from the ambient air and is connected to the inside volume of the tank, and the feeder means for feeding the inside volume of the casing further include a flexible tubular element that connects the second end of the transmission bar that is situated in the volume defined by the housing to outside air.

Preferably, the feeder means for feeding the inside volume of the casing include a flexible tube having one end opening out to the outside of the tank.

Preferably, said tubular element is a support element for the vacuum bottle for holding the vacuum bottle in position in the tank.

Preferably, the rod of the movable contact is connected to the drive means by a transmission bar that passes through associated orifices formed respectively in the casing and in the tank, and the circuit breaker includes dynamic sealing means arranged in these orifices.

DETAILED DESCRIPTION OF PARTICULAR EMBODIMENTS

Figure 1:
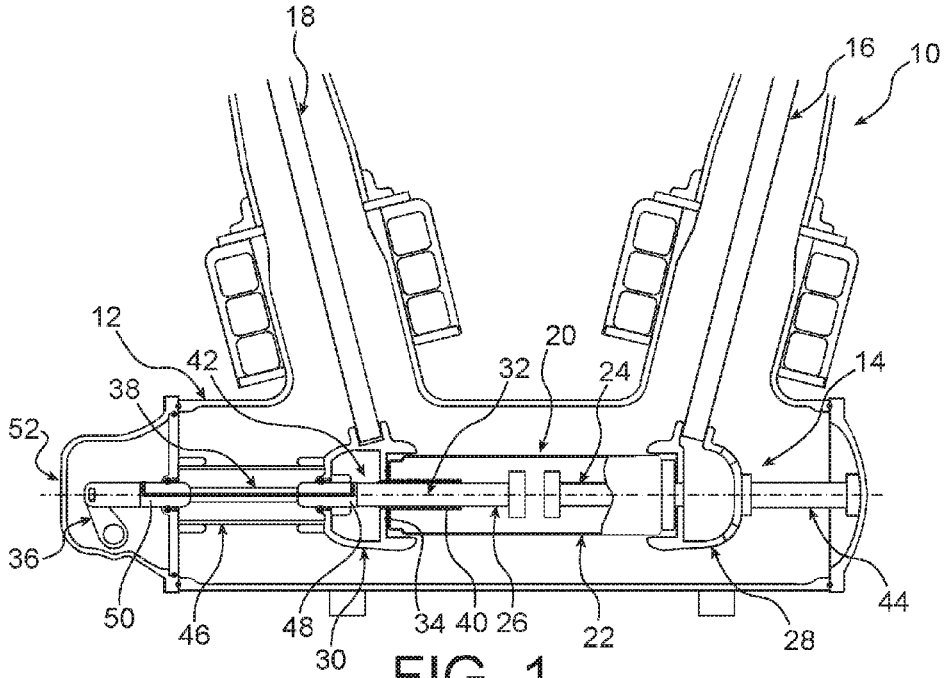
FIG. 1 is a section of a high voltage circuit breaker including connection means in a first embodiment of the invention.

The figures show a circuit breaker 10 for a high voltage electricity transport line.

The circuit breaker 10 comprises a tank 12 defining a hermetically closed volume 14, which volume is filled with a dielectric gas under pressure.

The circuit breaker 10 has two electrical conductors 16, 18 that are arranged in the inside volume 14 of the tank 12, together with a vacuum bottle 20 that is interposed between the two conductors 16, 18, and each terminal of the vacuum bottle 20 is connected to one of the two conductors 16, 18.

The vacuum bottle 20 comprises a hermetically sealed enclosure 22 in which the vacuum is formed, and it also includes a stationary contact 24 and a movable contact 26 that are arranged inside the enclosure 22.

Each contact 24, 26 of the vacuum bottle 20 is electrically connected in permanent manner to a respective associated conductor 16, 18 of the circuit breaker 10. This electrical connection takes place via casings 28, 30 mounted at each of the ends of the enclosure 22 of the vacuum bottle 20.

The movable contact 26 of the vacuum bottle is mounted to move relative to the stationary contact between a contact position in which the two contacts 24 and 26 are electrically connected together, thereby providing electrical connection between the two conductors 16 and 18, and a separated position as shown in the figures in which the two contacts 24 and 26, and consequently the two conductors 16 and 18, are not electrically connected together.

The vacuum formed inside the enclosure 22 is for limiting the formation of electric arcs between the stationary contact 24 and the movable contact 26 while breaking electrical contact between the two contacts 24 and 26.

In order to be driven to move relative to the stationary contact 24, the movable contact 26 has an axial rod 32 made of electrically conductive material that passes through an end wall 34 of the enclosure 22 of the vacuum bottle 20 and that is connected to drive means 36.

A transmission bar 38 made of electrically insulating material is interposed between the free end of the axial rod 32 and the drive means 36.

The drive means 36 are arranged outside the inside volume 14 defined by the tank 12. The transmission bar 38 thus passes through an opening formed in the wall of the tank 12. Sealing means are arranged at this opening to prevent any dielectric gas leaking out from the inside volume 14 of the tank 12.

The drive means 36 are arranged in a housing 52 adjacent to the tank 12 of the circuit breaker 10, serving to protect the drive means from external aggression.

Sealing means 40 are also arranged at the opening formed in the end wall 34 of the enclosure 22 of the vacuum chamber 20 for the purpose of isolating the inside volume of the vacuum chamber 20, while allowing the rod 32 of the movable contact 26 to move freely through the opening.

These sealing means 40 are situated between the opening in the end wall 34 and the rod 32 of the movable contact.

In a prior art embodiment, the sealing means 40 are constituted by a flexible sleeve or bellows having one end fastened to the end wall 34 around its opening, and having its other end fastened to the movable contact 26.

The vacuum bottle 20 is arranged at a distance from the wall of the tank 12.

The circuit breaker 10 thus has a first support 44 made of insulating material that is arranged between a wall of the tank 12 and the casing 28 that provides electrical connection between the stationary contact 24 and the associated conductor 16, and a second support 46 made of insulating material that is arranged between the wall of the tank through which the drive bar 38 passes and the casing 30 that provides electrical connection between the movable contact 26 and the associated conductor 18.

The second support 46 is tubular in shape in FIG. 1 and has the transmission bar 38 passing therethrough.

Each time the movable contact 26 moves in the vacuum bottle 20, the sealing means 40 are stressed.

Furthermore, the gas pressure in the inside volume 14 of the tank 12 is relatively high.

In order to protect the sealing means 40 from this high pressure, which might accelerate degradation of the sealing means, the casing 30 that provides the electrical connection between the movable contact 26 and the associated conductor 18 defines a hermetically sealed volume 42 that is isolated from the inside volume 14 of the tank 12 and from the inside volume of the enclosure 22 of the vacuum bottle.

This volume 42 is defined in part by the end wall 34 of the enclosure 22. Thus, the sealing means 40 between the end wall 34 and the rod 32 of the movable contact are in contact with the gas contained in this volume 42.

The gas pressure in the volume 42 defined by the casing 30 associated with the movable contact 26 is less than the gas pressure in the inside volume 14 of the tank 12. This pressure is preferably close to atmospheric pressure.

Thus, the pressure difference on either side of the sealing means 40 is limited, thereby limiting the stresses on the sealing means 40, and thus limiting the extent to which they become degraded during use of the circuit breaker 10.

The circuit breaker 10 also has feeder means for feeding the inside volume 42 of the casing 30 with gas in order to maintain its pressure at the predefined pressure, i.e. a pressure close to atmospheric pressure.

In accordance with the invention, these feeder means include a tubular element made of insulating material that passes through the tank and that opens out into the inside volume 42 of the casing 30.

The use of such a tubular element made of insulating material serves to retain a reasonable isolation distance between the casing 30 and the tank 12.

In a first embodiment as shown in FIG. 1, the tubular element for feeding the volume 42 is formed by the transmission bar 38.

A first end 48 of the transmission bar 38 is connected to the rod 32 of the movable contact 24. This first end includes an orifice whereby the duct formed in the transmission bar opens out into the volume 42 of the casing 30. The second end 50 of the transmission bar 38 is situated in the housing 52 that receives the drive means 36.

In this embodiment, the inside volume of the housing 52 is raised to the pressure that exists in the inside volume 42 of the casing 30, which pressure is different both from atmospheric pressure and from the pressure in the inside volume 14 of the tank 12.

The second end 50 of the transmission bar 38 also has an orifice whereby the duct formed in the transmission bar 38 opens out into the inside volume of the housing 52.

The orifices made in the ends 48 and 50 of the transmission bar 38 are positioned in the bar so that they always open out into the inside volume of the casing 30 or of the hosing 52, as the case may be.

Thus, the transmission bar connects together the inside volumes of the casing 30 and of the housing 52.

As mentioned above, the transmission bar 38 passes through orifices formed firstly through the casing 30 and secondly through the wall of the tank 12.

Dynamic sealing means are arranged in these openings in order to avoid any gas leakage to one or the other of the various volumes. These sealing means are of simpler design and present better resistance to wear than the sealing means 40 of the vacuum bottle.

Figure 2:
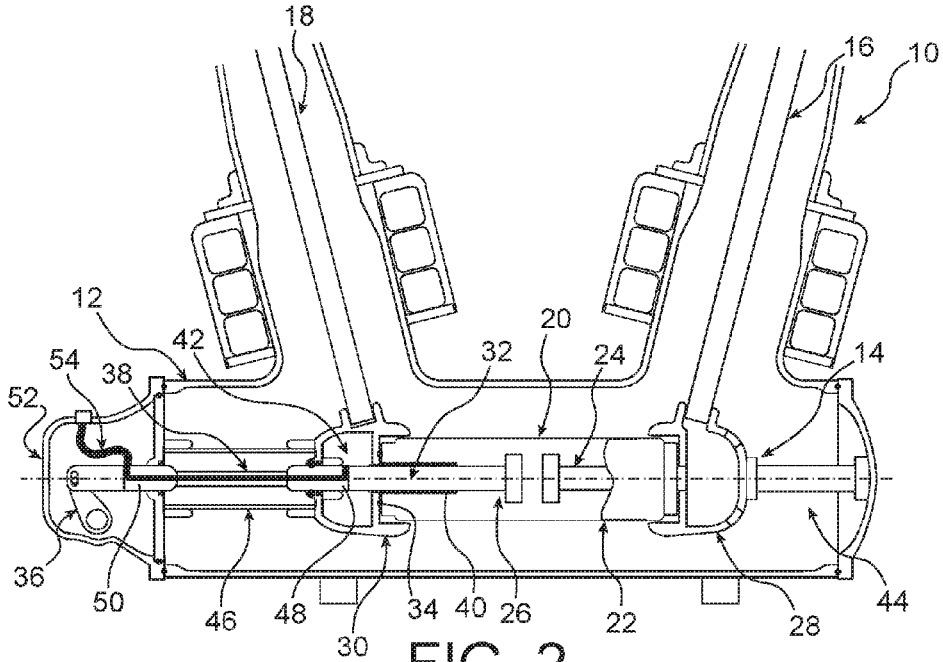
FIGS. 2 to 4 are views similar to FIG. 1 showing other embodiments of the invention.

FIG. 2 et seq. show various embodiments of the invention in which the inside volume 42 of the casing 30 is connected to ambient air via the feeder means.

In the embodiment shown in FIG. 2, the feeder means include the transmission bar 38, which is made of insulating material and which is tubular, as described above. The first end 48 of the transmission bar opens out into the inside volume 42 of the casing 30 and the second end 50 of the transmission bar 38 opens out into the inside volume of the housing 52.

Thus, the inside volume of the housing 52 communicates with the inside volume 14 of the tank 12, which means that it is filled with dielectric gas under high pressure.

Such an embodiment does not enable dynamic sealing means to be used between the transmission bar 38 and the wall of the tank 12 through which the transmission bar 38 passes.

The connection between the orifice in the second end of the transmission bar and outside air takes place via a flexible tube 54 that is also made of insulating material, having one end connected to the second end of the transmission bar 38 and having its other end opening out to the outside of the housing 52.

The flexibility of the tube 54 enables it to deform during movement of the transmission bar 38 while it is operating the circuit breaker.

Figure 3:
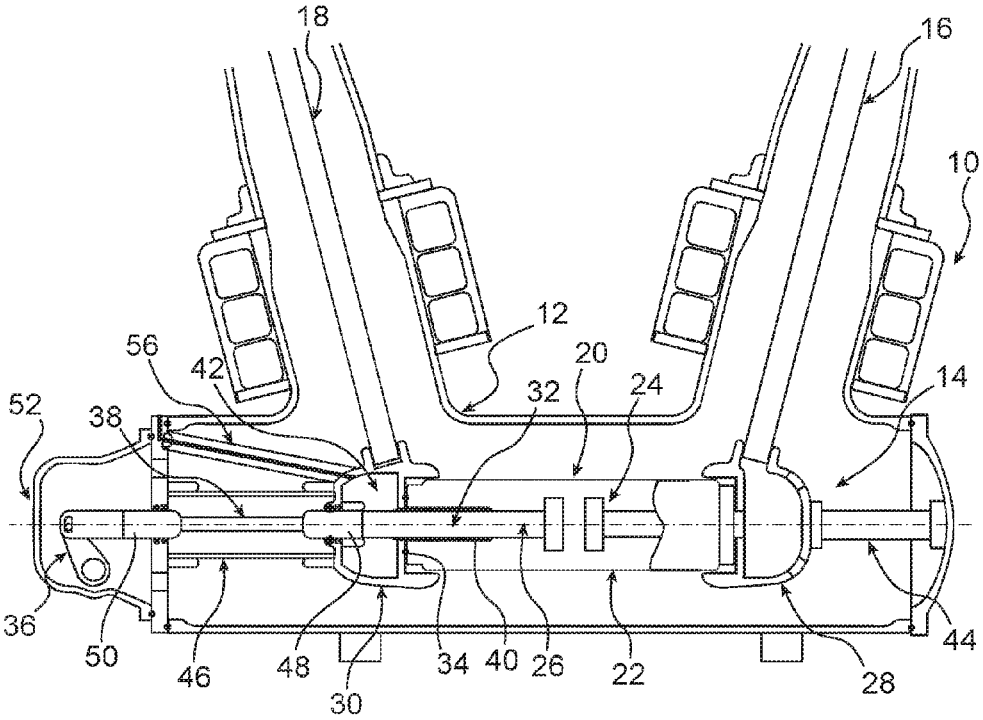

FIG. 3 shows another variant embodiment in which the connection to the inside volume of the casing 30 takes place via an arm 56 having a first end opening out into an opening formed in the casing 30 and having its other end opening out to the outside via an opening formed in the wall of the tank 12.

Figure 4:
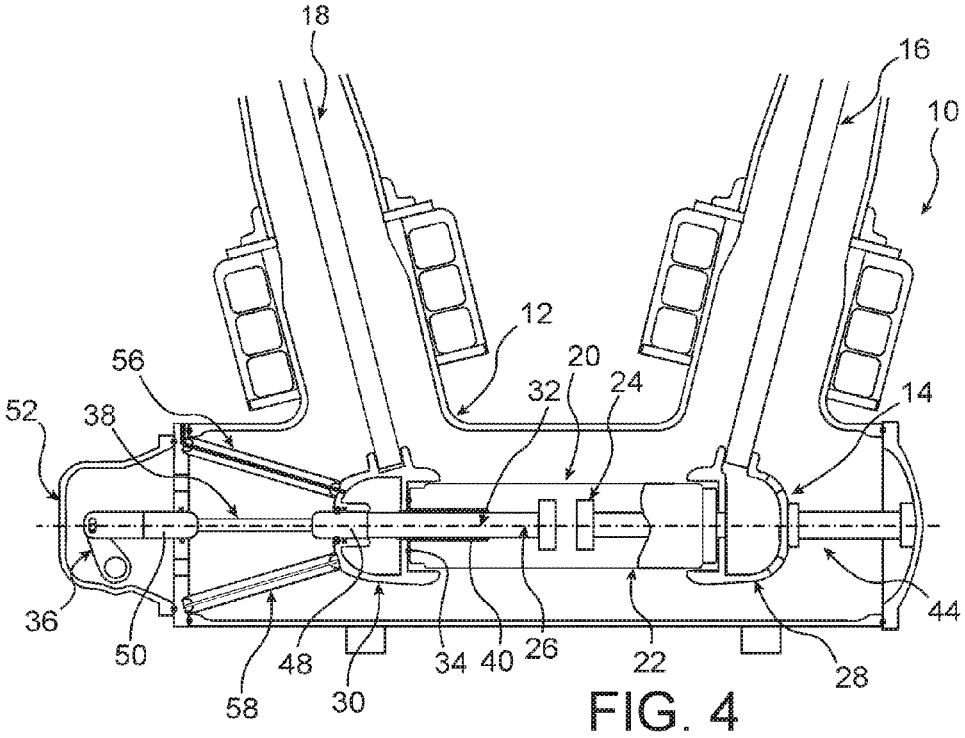

FIG. 4 shows yet another variant embodiment in which the tubular arm 56 also serves to support the vacuum bottle 20.

The tubular arm 56 is associated with one or more arms 58 made of insulating material, and together these arms 56 and 58 are fastened to the casing 30 associated with the movable contact 26 for the purpose of supporting the vacuum bottle 20 and holding it in position.

This embodiment of the invention makes it possible to avoid using an insulating support of the kind shown in the other embodiments, and having the transmission bar 38 passing therethrough.

The use of a tubular arm for directly connecting the inside volume 42 of the casing to outside air enables the structure of the circuit breaker to be simplified, in particular concerning the number of dynamic sealing means and the number of components.

In these two variant embodiments, there is only one tubular element for connecting the inside volume 42 of the casing 30, and there is only one dynamic sealing system that is situated at the opening of the casing 30 through which the transmission bar 38 passes.

What is claimed is:

1. A circuit breaker (10) for an electricity transport installation, the circuit breaker comprising:

a tank (12) defining a first volume (14) filled with a dielectric gas under pressure;

a vacuum bottle (20) arranged in the tank (12), the vacuum bottle (20) comprising:

an enclosure (22) in which a vacuum is made, the enclosure (22) defining a second volume, a stationary contact (24) and a movable contact (26) arranged in the enclosure (22) of the vacuum bottle (20), in which the movable contact (26) includes a drive rod (32) that passes through an opening formed in an end wall (34) of the enclosure (22) and that is connected to drive means (36) for driving the movable contact (26), and sealing means (40) between the edge of the opening in said end wall (34) of the enclosure (22) and the movable contact (26);

a casing (30) arranged in the tank (12) and electrically connecting the movable contact (26) to an electrical conductor (18), wherein the casing 30 co-operates with said end wall (34) of the enclosure (22) of the vacuum bottle (20) to define a third volume (42) that is isolated from the first volume (14) of the tank (12) and the second volume of the enclosure (22) of the vacuum bottle (20), wherein the third volume (42) is taken to a pressure close to atmospheric pressure; and a tubular element that passes through the first volume (14) of the tank (12) and is configured to feed gas through the tubular element to the third volume (42) of the casing (30).

2. The circuit breaker (10) according to claim 1, wherein said tubular element is a motion transmission bar (38) that extends from the drive means (36) to the rod (32) of the movable contact (26), the motion transmission bar (38) having one end (48) connected to the rod (32) of the movable contact (26) and opening out inside the inside volume (42) of the casing (30).

3. The circuit breaker (10) according to claim 2, wherein the motion transmission bar (38) passes through a wall of the tank (12) in a sealed manner and includes another end (50) that is situated outside of the tank (12).

4. The circuit breaker (10) according to claim 3, further comprising a housing (52) adjacent to the tank (12), wherein the housing defines a closed volume in which at least a portion of the drive means (36) and the second end (50) of the transmission bar (38) are situated.

5. The circuit breaker (10) according to claim 4, wherein the closed volume defined by the housing (52) is isolated from ambient air and from the first volume of the tank (12) and is connected to the third volume (42) of the casing (30) via the transmission bar (38).

6. The circuit breaker (10) according to claim 2, wherein:

the closed volume defined by the housing is isolated from ambient air and is connected to the first volume (14) of the tank (12), and a flexible tubular element (54) connects the second end (50) of the transmission bar (38) that is situated in the closed volume defined by the housing to the outside air.

7. The circuit breaker (10) according to claim 1, further comprising a flexible tube (54) having one end opening out to the outside of the tank (12).

8. The circuit breaker (10) according to claim 1, wherein said tubular element is a support element (56) for the vacuum bottle (20) for holding the vacuum bottle (20) in position in the tank (12).

9. The circuit breaker (10) according to claim 1, wherein:

the rod (32) of the movable contact (26) is connected to the drive means (36) by a transmission bar (38) that passes through associated orifices formed respectively in the casing (30) and in the tank (12), and the circuit breaker includes dynamic sealing means arranged in the associated orifices.

* * * * *